US007817125B2

(12) United States Patent
Ono et al.

(10) Patent No.: US 7,817,125 B2
(45) Date of Patent: Oct. 19, 2010

(54) DISPLAY DEVICE

(75) Inventors: Kikuo Ono, Mobara (JP); Yoshihiro Imajo, Mobara (JP)

(73) Assignee: Hitachi Displays, Ltd., Chiba-ken (JP)

( * ) Notice: Subject to any disclaimer, the term of this patent is extended or adjusted under 35 U.S.C. 154(b) by 1018 days.

(21) Appl. No.: 11/350,084

(22) Filed: Feb. 9, 2006

(65) Prior Publication Data

US 2006/0187165 A1 Aug. 24, 2006

(30) Foreign Application Priority Data

Feb. 22, 2005 (JP) ..... 2005-045518

(51) Int. Cl.
*G09G 3/36* (2006.01)

(52) U.S. Cl. ..... 345/94

(58) Field of Classification Search ..... 345/87–104
See application file for complete search history.

(56) References Cited

U.S. PATENT DOCUMENTS 5,654,735 A * 8/1997 Nakajima ..... 345/99
5,748,169 A * 5/1998 Okumura et al. ..... 345/100
5,774,099 A * 6/1998 Iwasaki et al. ..... 345/87
5,936,617 A * 8/1999 Uchino et al. ..... 345/204
5,995,075 A * 11/1999 Vignolle ..... 345/94
6,157,358 A * 12/2000 Nakajima et al. ..... 345/96
6,795,050 B1 * 9/2004 Ino et al. ..... 345/100
6,965,366 B2 * 11/2005 Ozawa ..... 345/89
7,027,024 B2 * 4/2006 Yanagi et al. ..... 345/94
7,414,601 B2 * 8/2008 Yoo ..... 345/87
2001/0033266 A1 * 10/2001 Lee ..... 345/94
2003/0122765 A1 * 7/2003 Yoon ..... 345/94
2005/0062706 A1 * 3/2005 Mizumaki ..... 345/94

FOREIGN PATENT DOCUMENTS

JP 2001-125069 5/2001

* cited by examiner

*Primary Examiner*—Alexander Eisen
*Assistant Examiner*—Nelson Lam
(74) *Attorney, Agent, or Firm*—Stites & Harbison PLLC; Juan Carlos A. Marquez, Esq.

(57) ABSTRACT

In a display device in which each pixel includes a thin film transistor which is turned on in response to a scanning signal from a gate signal line, and an electrode to which a video signal from a drain signal line is supplied through the thin film transistor, the scanning signal allows a voltage level thereof which turns on the thin film transistor to have a valley portion which decreases the voltage level in a midst portion thereof, and the decreased voltage level of the valley portion is set to a value which is equal to or more than a voltage level which turns off the thin film transistor.

14 Claims, 10 Drawing Sheets

DISPLAY DEVICE

CLAIM OF PRIORITY

The present application claims priority from Japanese application serial No. 2005-45518, filed on (Feb. 22, 2005), the content of which is hereby incorporated by reference into this application.

BACKGROUND OF THE INVENTION

1. Field of the Invention

The present invention relates to a display device, and more particularly to an active-matrix-type display device.

2. Description of the Related Art

In the active-matrix-type display device, on a surface of a substrate thereof, for example, a plurality of gate signal lines which extend in the x direction and are arranged in parallel in the y direction and a plurality of drain signal lines which extend in the y direction and are arranged in parallel in the x direction are formed, wherein the display device includes pixel regions each of which has a corner portion at each intersecting portion of these signal lines.

Each pixel region includes at least a thin film transistor which is turned on in response to the supply of a signal (scanning signal) from the gate signal line, and an electrode to which a signal (video signal) is supplied from the drain signal line through the thin film transistor.

This electrode, for example, constitutes one-side electrode which generates an electric field in the inside of liquid crystal in case of a liquid crystal display device, and constitutes an electrode which operates a drive switch element for allowing an electric current to flow into an organic EL element in case of an organic EL display device.

In the display device having such a constitution, by sequentially supplying the scanning signal to the respective gate signal lines from an upper stage to a lower stage, for example, the video signal is supplied to the respective drain signal lines in conformity with the sequential-supply timing of the scanning signal.

Due to such a constitution, through the thin film transistors which are turned on for every pixel row of each stage, the video signal is supplied to the electrodes of the respective pixels of the pixel row.

Further, as the above-mentioned scanning signal which serves to turn on the thin film transistors, usually, a square wave signal is used. That is, the square wave signal is formed of a pulse which rises from a reference potential (low level), holds a fixed voltage (high level) and, thereafter, falls to the reference potential.

However, the scanning signal is not limited to such a square wave signal, and there has been known a wave signal whose waveform is modified as disclosed in a following patent document 1, for example.

That is, the scanning signal disclosed in JP-A-2001-125069 (patent document 1) does not use a square pulse but uses a pulse in which a fixed voltage (high level) is held and, thereafter, the voltage is continuously lowered along with a lapse of time and, thereafter, falls to a reference potential (low level). With the use of such a scanning signal, the irregularities of brightness attributed to a delay of signal due to a gate signal line can be suppressed.

SUMMARY OF THE INVENTION

However, when the square wave signal is used as the scanning signal which serves to turn on the thin film transistor, a signal which is taken out from another electrode in response to a signal (video signal) which is supplied to one electrode of the thin film transistor rises toward a voltage value of the video signal from a point of time that the scanning signal is supplied to the thin film transistor (rising point of time). However, the signal which is taken out from another electrode does not reach the level of the video signal at a point of time that the scanning signal is no more supplied (falling point of time). Accordingly, there has been a strong demand for the enhancement of a voltage writing ratio.

Such a demand cannot be achieved by the modification of the waveform described in the above-mentioned patent document 1.

Accordingly, the present invention has been made under such circumstances and it is an object of the present invention to provide a display device which can realize a high voltage writing ratio.

To briefly explain the summary of typical inventions among inventions disclosed in this specification, they are as follows.

(1) The present invention is directed to a display device in which each pixel includes a thin film transistor which is turned on in response to a scanning signal from a gate signal line, and an electrode to which a video signal from a drain signal line is supplied through the thin film transistor, wherein the scanning signal allows a voltage level thereof which turns on the thin film transistor to have a valley portion which decreases the voltage level in a midst portion thereof, and the decreased voltage level of the valley portion is set to a value which is equal to or more than a voltage level which turns off the thin film transistor.

(2) The display device according to the present invention is, for example, on the premise of the constitution (1) characterized in that the valley portion which is held at the voltage level is gradually lowered along with a lapse of time and, thereafter, rises steeply.

(3) The display device according to the present invention is, for example, on the premise of the constitution (1) characterized in that the valley portion which is held at the voltage level falls for a time t1 and rises for a time t2, wherein a relationship t1>t2 is established.

(4) The display device according to the present invention is, for example, on the premise of any one of the constitutions (1), (2) and (3), characterized in that the decreased voltage level of the valley portion of the scanning signal line is set larger than the voltage level of the video signal supplied to the thin film transistor.

(5) The present invention is directed to a display device in which each pixel includes a thin film transistor which is turned on in response to a scanning signal from a gate signal line, and an electrode to which a video signal from a drain signal line is supplied through the thin film transistor, wherein the scanning signal allows a voltage level thereof which turns on the thin film transistor to have a valley portion which decreases the voltage level in a midst portion thereof and, at the same time, a decreasing portion which gradually decreases the voltage level immediately before turning off the thin film transistor, and the decreased voltage levels at the valley portion and the decreasing portion are set to values equal to or more than a voltage level which turns off the thin film transistor.

(6) The display device according to the present invention is, for example, on the premise of the constitution (5) characterized in that after the voltage level is gradually decreased in the decreasing portion, the voltage level steeply reaches a low level of the scanning signal.

(7) The display device according to the present invention is, for example, on the premise of the constitution (5) characterized in that the valley portion which is held at the voltage level is gradually lowered along with a lapse of time and, thereafter, steeply rises.

(8) The display device according to the present invention is, for example, on the premise of the constitution (5) characterized in that the valley portion which is held at the voltage level falls for a time t1 and rises for a time t2, wherein a relationship t1>t2 is established.

(9) The display device according to the present invention is, for example, on the premise of any one of the constitutions (5), (6), (7) and (8), characterized in that the decreased voltage levels of the valley portion and the decreasing portion of the scanning signal line are set larger than the voltage level of the video signal supplied to the thin film transistor.

(10) The present invention is directed to a display device in which each pixel includes a thin film transistor which is turned on in response to a scanning signal from a gate signal line, and an electrode to which a video signal from a drain signal line is supplied through the thin film transistor, wherein the scanning signal allows a voltage level thereof which turns on the thin film transistor to have a valley portion which decreases the voltage level in a midst portion thereof and, at the same time, a decreasing portion which gradually decreases the voltage level immediately before turning off the thin film transistor, the decreased voltage levels at the valley portion and the decreasing portion are set to values equal to or more than a voltage level which turns off the thin film transistor, and one scanning signal and another scanning signal which is supplied next to one scanning signal are supplied in a partially overlapped manner in a state that the decreasing portion of one scanning signal and the valley portion of another scanning signal are aligned with each other in terms of time.

(11) The display device according to the present invention is, for example, on the premise of the constitution (10) characterized in that after the voltage level is gradually decreased in the decreasing portion, the voltage level steeply reaches a low level of the scanning signal.

(12) The display device according to the present invention is, for example, on the premise of the constitution (10) characterized in that the valley portion which is held at the voltage level is gradually lowered along with a lapse of time and, thereafter, steeply rises.

(13) The display device according to the present invention is, for example, on the premise of the constitution (10) characterized in that the valley portion which is held at the voltage level falls for a time t1 and rises for a time t2, wherein a relationship t1>t2 is established.

(14) The display device according to the present invention is, for example, on the premise of any one of the constitutions (10), (11), (12) and (13), characterized in that the decreased voltage levels of the valley portion and the decreasing portion of the scanning signal line are set larger than the voltage level of the video signal supplied to the thin film transistor.

The present invention is not limited to the above-mentioned constitutions and various modifications can be made without departing from the technical concept of the present invention.

BRIEF DESCRIPTION OF THE DRAWINGS

FIG. 2A to FIG. 2C are views for explaining the display device according to the present invention, wherein FIG. 2A is a schematic plan view, and FIG. 2B and FIG. 2C are equivalent circuit diagrams of a pixel;

DESCRIPTION OF THE PREFERRED EMBODIMENTS

Hereinafter, embodiments of a display device according to the present invention are explained in conjunction with attached drawings.

Figure 2A:
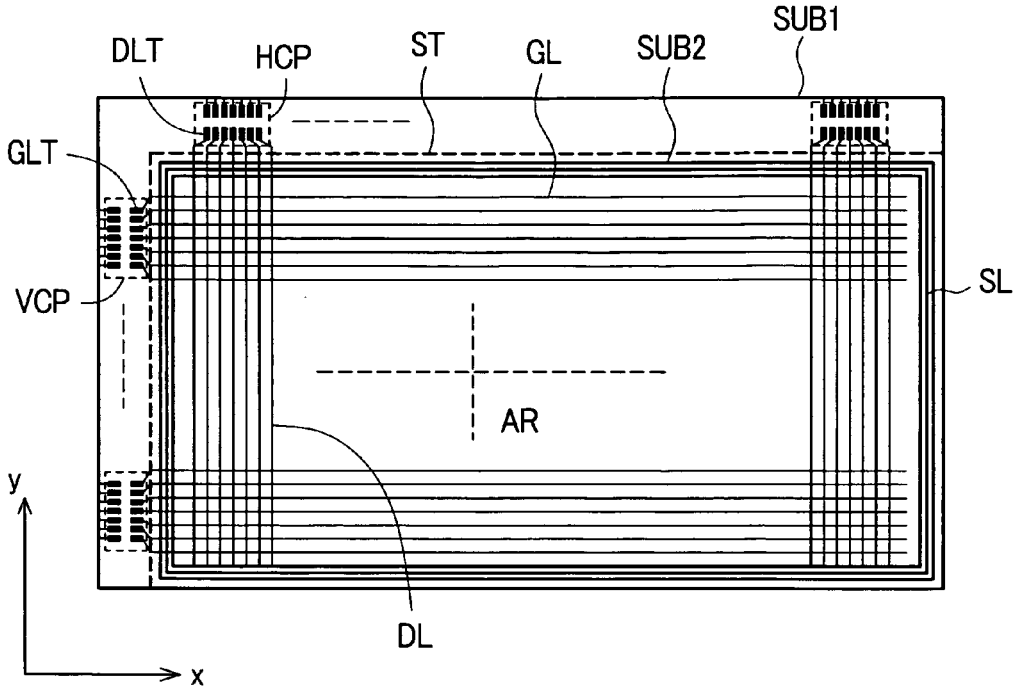

FIG. 2A is a schematic plan view showing one embodiment of a liquid crystal display device according to the present invention.

The liquid crystal display device includes a transparent substrate SUB1 and a transparent substrate SUB2 which is arranged to face a main surface of the transparent substrate SUB1 in an opposed manner by way of liquid crystal. The transparent substrate SUB1 is formed with a size slightly larger than a size of the transparent substrate SUB2, and electronic circuits (semiconductor chips VCP, HCP described later) are mounted on a portion of the transparent substrate SUB1 which does not face the transparent substrate SUB2.

The transparent substrate SUB2 is fixed to the transparent substrate SUB1 using a sealing material SL formed on a periphery of the transparent substrate SUB2. The sealing material SL also has a function of sealing the liquid crystal which is sandwiched between the transparent substrate SUB1 and the transparent substrate SUB2.

Further, a region surrounded by the sealing material SL functions as a liquid crystal display part AR and a large number of pixels which are arranged in a matrix array are formed in the inside of the liquid crystal display part AR.

That is, in the liquid crystal display part AR formed on a main surface (liquid-crystal-side surface) of the transparent substrate SUB1, a large number of gate signal lines GL which extend in the x direction in the drawing and are arranged in parallel in the y direction in the drawing are mounted. One-end side (left side in the drawing) of the gate signal lines GL extends over the sealing material SL to reach the outside of the sealing material SL, and gate signal terminals GLT are formed on the extended ends.

Each gate signal line GL forms one group together with the neighboring gate signal lines GL, and the gate signal lines GL in the inside of each group are converged to each other in a process in which the gate signal lines GL extend over the sealing material SL, and reach the above-mentioned gate signal terminals GLT.

The gate signal terminals GLT of each group are connected with output bumps of one semiconductor chip VCP which constitutes a scanning signal drive circuit. The above-mentioned converging of the gate signal lines GL is attributed to a fact that a spaced-apart distance between the gate signal lines GL is larger than a spaced-apart distance between the output bumps of the semiconductor chip VCP.

Here, terminals which are connected to input bumps of the semiconductor chip VCP are also formed on the surface of the transparent substrate SUB1, wherein signals are supplied to the terminals from a periphery of the transparent substrate SUB1.

Further, in the liquid crystal display part AR formed on the main surface (liquid-crystal-side surface) of the transparent substrate SUB1, a large number of drain signal lines DL which extend in the y direction in the drawing and are arranged in parallel in the x direction in the drawing are mounted. One-end side (upper side in the drawing) of the drain signal lines DL extends over the sealing material SL to reach the outside of the sealing material SL, and drain signal terminals DLT are formed on the extended ends.

Each drain signal line DL forms one group together with the neighboring drain signal lines DL, and the drain signal lines DL in the inside of each group are converged to each other in a process in which the drain signal lines DL extend over the sealing material SL, and reach the above-mentioned drain signal terminals DLT.

The drain signal terminals DLT of each group are connected with output bumps of one semiconductor chip HCP which constitutes a video signal drive circuit. The above-mentioned converging of the drain signal lines DL is attributed to a fact that a spaced-apart distance between the drain signal lines DL is larger than a spaced-apart distance between the output bumps of the semiconductor chip HCP.

Here, terminals which are connected to input bumps of the semiconductor chip HCP are also formed on the surface of the transparent substrate SUB1, wherein signals are supplied to the terminals from a periphery of the transparent substrate SUB1.

Here, regions which are surrounded by the gate signal lines GL and the drain signal lines DL form pixel regions.

Figure 2B:
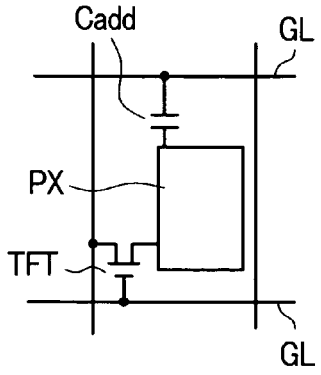

FIG. 2B shows one embodiment of the constitution in the inside of the pixel region surrounded by the gate signal lines GL which are arranged close to each other and the drain signal lines DL which are arranged close to each other in a form of an equivalent circuit.

The pixel region includes a thin film transistor TFT which is turned on in response to the supply of a signal (scanning signal) from the gate signal line GL, while a signal (video signal) from the drain signal line DL drain signal line is supplied to a pixel electrode PX through the thin film transistor TFT.

An electric field corresponding to the video signal is generated between the pixel electrode PX and a counter electrode CT, and the liquid crystal is activated corresponding to a magnitude of the electric field. Here, in the drawing, the counter electrode CT is formed on another transparent substrate SUB2 side which differs from the transparent substrate SUB1 on which the pixel electrode PX is formed and hence, the counter electrode CT is not illustrated in the drawing.

Further, out of the respective gate signal lines GL which are arranged with the pixel region sandwiched therebetween, between another gate signal line GL which differs from the gate signal line GL for driving the thin film transistor TFT in the pixel region and the pixel electrode PX, a capacitive element Cadd is formed, and the video signal which is supplied to the pixel electrode PX is stored by the capacitive element Cadd for a relatively long time.

Figure 2C:
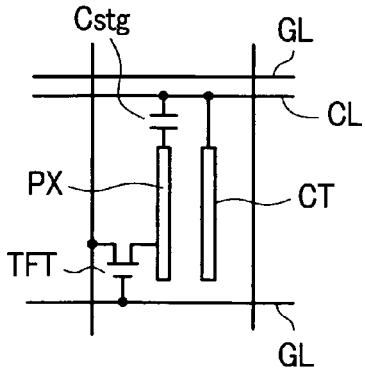

Further, FIG. 2C is an equivalent circuit diagram showing another embodiment of the constitution in the inside of the above-mentioned pixel region. The constitution which differs from the constitution shown in FIG. 2B lies in that, first of all, the constitution includes a counter voltage signal line CL besides the gate signal line GL and the drain signal line DL. This is because that the counter electrode CT is mounted on the transparent substrate SUB1 side and hence, it is necessary to provide a signal line which supplies a counter voltage signal to the counter electrode CT as the counter voltage signal line CL.

Further, liquid crystal is activated by an electric field which is generated between the pixel electrode PX and the counter electrode CT both of which are mounted on the transparent substrate SUB1 side. In this case, the pixel electrode PX and the counter electrode CT are usually respectively formed of a group of electrodes consisting of a plurality of electrodes, wherein these respective electrodes are arranged in a fit-in pattern in which each one electrode is sandwiched by two another electrodes.

A capacitive element which serves to store the video signal supplied to the pixel electrode PX is constituted of a capacitive element Cstg which is connected between the pixel electrode PX and the counter voltage signal line CL.

In either one of pixels shown in FIG. 2B and FIG. 2C, when the scanning signal is supplied to the gate signal line GL, the thin film transistor TFT which is connected with the gate signal line GL is turned on, and the video signal from the drain signal line DL which is supplied in conformity with the timing of the supply of the scanning signal line is supplied to the pixel electrode PX through the thin film transistor TFT.

Figure 1:
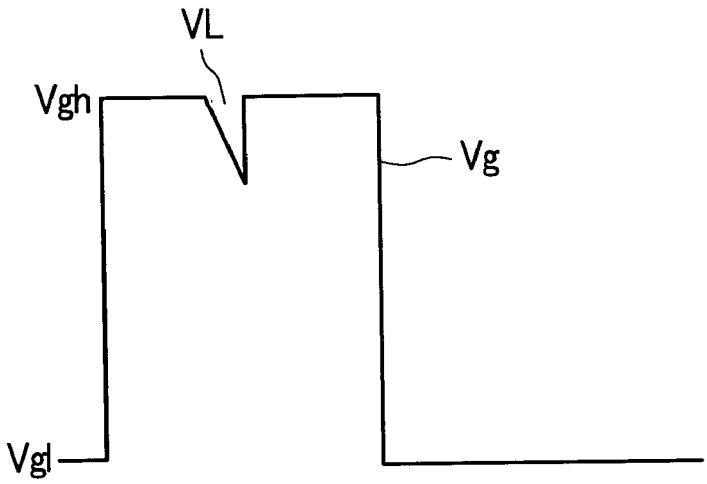
FIG. 1 is a view showing one embodiment of the constitution of a scanning signal which is applied to a display device according to the present invention.

FIG. 1 is a view showing a waveform of the scanning signal Vg which is sequentially supplied to the respective gate signal lines GL from the scanning signal drive circuit V.

The scanning signal Vg is schematically indicated as a square wave which assumes a high level Vgh for a fixed period from a low level Vgl, wherein the scanning signal Vg has a valley portion VL in the midst of the period of the high level Vgh.

That is, the scanning signal Vg rises to the high level Vgh from the low level Vgl, holds the high level Vgh for a fixed time and, thereafter, gradually lowers a voltage thereof, and steeply rises to the high level Vgh again. In this case, the gradual lowering of the voltage and the rising of the voltage to the high level Vgh again thereafter are referred to as the above-mentioned valley portion VL. Thereafter, the scanning signal Vg holds the high level Vgh for a fixed time and, thereafter, assumes the low level Vgl.

Here, as will be apparent from the explanation made later, a rate of the lowering of the voltage in the above-mentioned valley portion VL is considerably small compared to the change of the voltage reaching the high level Vgh from the low level Vgl. Accordingly, in a state that the vide signal Vd is applied to a drain electrode (electrode on a side which is connected to the drain signal line DL) of the thin film transistor TFT, when the scanning signal Vg is applied to the gate electrode, even when the lowering of voltage in the above-mentioned valley portion VL is generated in the scanning signal Vg, the scanning signal Vg still possesses the voltage value which is larger than the voltage value of the video signal Vd.

Figure 3:
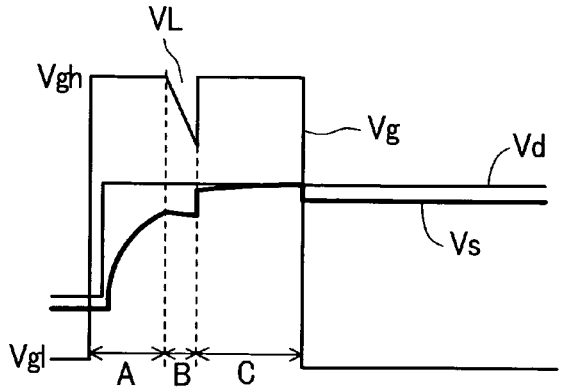
FIG. 3 is a view showing the relationship between the scanning signal and a video signal which are applied to the display device according to the present invention.

FIG. 3 is a graph showing the relationship between respective waveforms of the video signal Vd which is supplied to the drain electrode (electrode on the side which is connected to the drain signal line DL) of the thin film transistor TFT in an ON operation state and a signal which appears on a source electrode (electrode on a side which is connected with pixel electrode PX) of the thin film transistor TFT (referred to as pixel signal Vs for the sake of convenience).

Here, in FIG. 3, a section in which the scanning signal Vg assumes the high level Vgh and reaches the above-mentioned valley portion VL is indicated as a section A, a section in the above-mentioned valley portion VL is indicated as a section B, and a section in which the scanning signal Vg assumes the low level Vgl through the above-mentioned valley portion VL is indicated as a section C.

The pixel signal Vs rises toward the video signal Vd from a point of time of supplying the scanning signal Vg. Here, in the section B, the scanning signal Vg lowers the voltage thereof although the voltage of the pixel signal Vs is lowered along with the lowering of the voltage of the scanning signal Vg, since the lowering of the scanning signal Vg is limited to a value which is equal to or more than a maximum voltage of the video signal Vd, the lowering of the pixel signal Vs is limited.

Then, the voltage of the scanning signal Vg is sharply increased in the change from the section B to the section C and hence, the voltage of the pixel signal Vs is sharply increased due to capacitive coupling of the gate and the source.

In view of the above, compared to a case in which the scanning signal Vg has no valley portion VL, it is possible to obtain a high voltage writing ratio.

The above-mentioned scanning signal Vg, in the valley portion VL, gradually falls initially and, thereafter, rises steeply.

In this case, the steepness of the rising of the voltage after the lowering of the voltage is grasped as a relative value. That is, in the above-mentioned valley portion VL, assuming the time from a point of time that the lowering of the voltage is started to a point of time that the voltage assumes the lowermost value as t1 and the time from the point of time that the voltage assumes the lowermost value to a point of time that the voltage reaches the level of Vgh as t2, it is sufficient that the relationship t1>t2 is established, and the closer the time t2 approaches 0, the rising of the lowered value becomes steep.

Further, the above-mentioned scanning signal Vg is divided into the section A, the section B and the section C during the period in which the scanning signal Vg rises to the high level Vgh from the low level Vgl and, thereafter, the scanning signal Vg assumes the low level Vgl again, and the scanning signal Vg includes the valley portion VL in the section B.

In this case, by setting a time width of the section A as tA, a time width of the section B as tB and a time width of the section C as tC, the relationships are set tB<tA and tB<tC.

These relationships are set so as to realize a boost effect in the valley portion VL while holding a high state of the high level Vgh. That is, if these relationships are reversed, an apparent time of a gate ON state becomes short thus deteriorating the writing to the centrally.

Figure 4A:
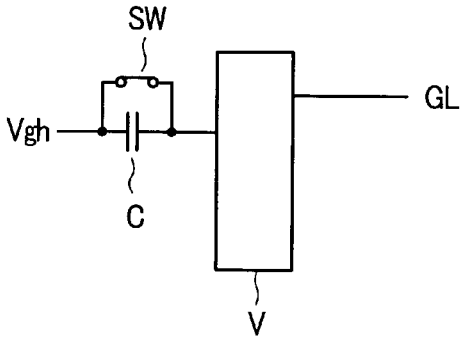
FIG. 4A and FIG. 4B are constitutional views showing a means which forms the scanning signal which is applied to the display device according to the present invention.
Figure 4B:
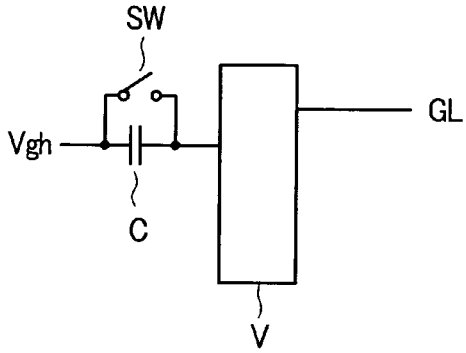

FIG. 4A and FIG. 4B are views which respectively show the above-mentioned scanning signal drive circuit V and show the signal which is inputted to the scanning signal drive circuit V at the time of outputting the scanning signal Vg to the gate signal line GL.

In FIG. 4A and FIG. 4B, the scanning signal drive circuit V is configured such that the scanning signal Vg is inputted to the scanning signal drive circuit V through a capacitor C and, at the same time, a switching element SW is connected to both ends of the capacitor C.

In FIG. 4A, the switching element SW is turned ON and hence, the scanning signal Vg is inputted to the scanning signal drive circuit V through the switching element SW without flowing through the capacitor C.

The scanning signal Vg which is inputted to the scanning signal drive circuit V is used as the signal during the period in which the scanning signal Vg assumes the high level, wherein the scanning signal drive circuit V is operated to allow the switching element SW to be turned on during the periods corresponding to the section A and the section C of the scanning signal Vg outputted in FIG. 3 as described above.

In FIG. 4B, the switching element SW is turned OFF and hence, the scanning signal Vg is inputted to the scanning signal drive circuit V through the capacitor C without flowing through the switching element SW.

The scanning signal drive circuit V is configured to allow the switching element SW to be turned OFF during the period corresponding to the section B of the scanning signal Vg outputted in FIG. 3 as described above.

Accordingly, at a portion corresponding to the valley portion VL of the scanning signal Vg, by turning OFF the switching element SW, the voltage stored in the capacitor C is gradually lowered thus generating a slope-like voltage change, while by turning ON the switching element SW again in the section C, the scanning signal Vg is directly supplied to the scanning signal drive circuit V and hence, the voltage Vgh of the high level state is rapidly restored.

Figure 5:
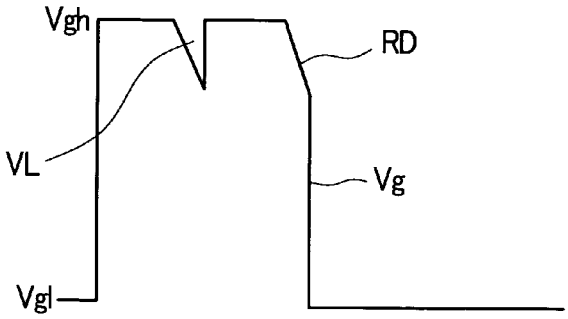
FIG. 5 is a view showing another embodiment of the constitution of the scanning signal which is applied to the display device according to the present invention.

FIG. 5 is a waveform diagram showing another embodiment of the scanning signal Vg and corresponds to FIG. 2. The constitution which makes the scanning signal Vg in FIG. 5 different from the scanning signal Vg in FIG. 2 lies in that the falling of the scanning signal Vg to the low level Vgl possesses a reducing portion RD which exhibits the gentle lowering of voltage immediately before the falling.

Accordingly, the scanning signal Vg when viewed as the whole, assumes the high level Vgh from the low level Vgl, passes the valley portion VL, passes through the reducing portion RD which exhibits the gentle lowering of voltage from the high level Vgh, and steeply falls to assume the low level Vgl.

In this case, with respect to the lowering of voltage of the reducing portion RD which features this embodiment, a gradient of the lowering may not be always equal to a gradient of the lowering of the voltage in the above-mentioned valley portion VL, these gradients may be set equal to each other.

Here, as will be apparent from the explanation made later, a rate of the gentle lowering of the voltage at the time of falling in the reducing portion RD is considerably small compared to the change of the voltage reaching the low level Vgl from the high level Vgh. Accordingly, in a state that the vide signal Vd is applied to a drain electrode (electrode on a side which is connected to the drain signal line DL) of the thin film transistor TFT, when the scanning signal Vg is applied to the gate electrode, even when the above-mentioned gentle lowering of voltage at the time of falling is generated in the scanning signal Vg, the scanning signal Vg still possesses the voltage value which is larger than the voltage value of the video signal Vd.

Figure 6:
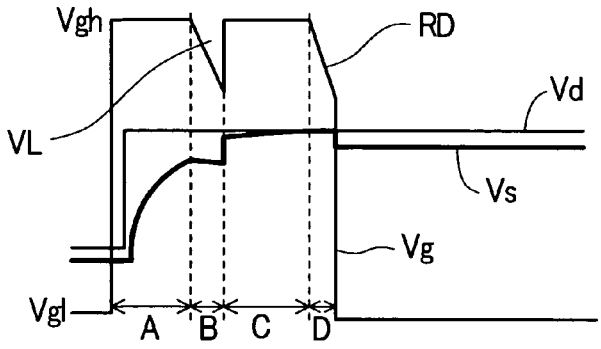
FIG. 6 is a view showing the relationship between the scanning signal and a video signal which are applied to the display device according to the present invention.

FIG. 6 is a graph showing the relationship between respective waveforms of the video signal Vd which is supplied to the drain electrode (electrode on the side which is connected to the drain signal line DL) of the thin film transistor TFT in an ON operation state and a signal which appears on a source electrode (electrode on a side which is connected with pixel electrode PX) of the thin film transistor TFT (referred to as pixel signal Vs for the sake of convenience). FIG. 6 corresponds to FIG. 3.

A portion which makes this case different from the case shown in FIG. 3 lies in that a section D in which the voltage is gently lowered at the time of falling in the reducing portion RD of the scanning signal Vg is newly provided besides the section A, the section B and the section C. Operations which are performed in the section A, the section B and the section C are exactly equal to the operations explained in conjunction with FIG. 3. Further, it is also possible to obtain an advantageous effect that in the section D, the jumping when the scanning signal Vg is changed from an ON state to an OFF state can be lowered and, at the same time, it is possible to allow the value of Vs to the value of Vd.

Figure 7:
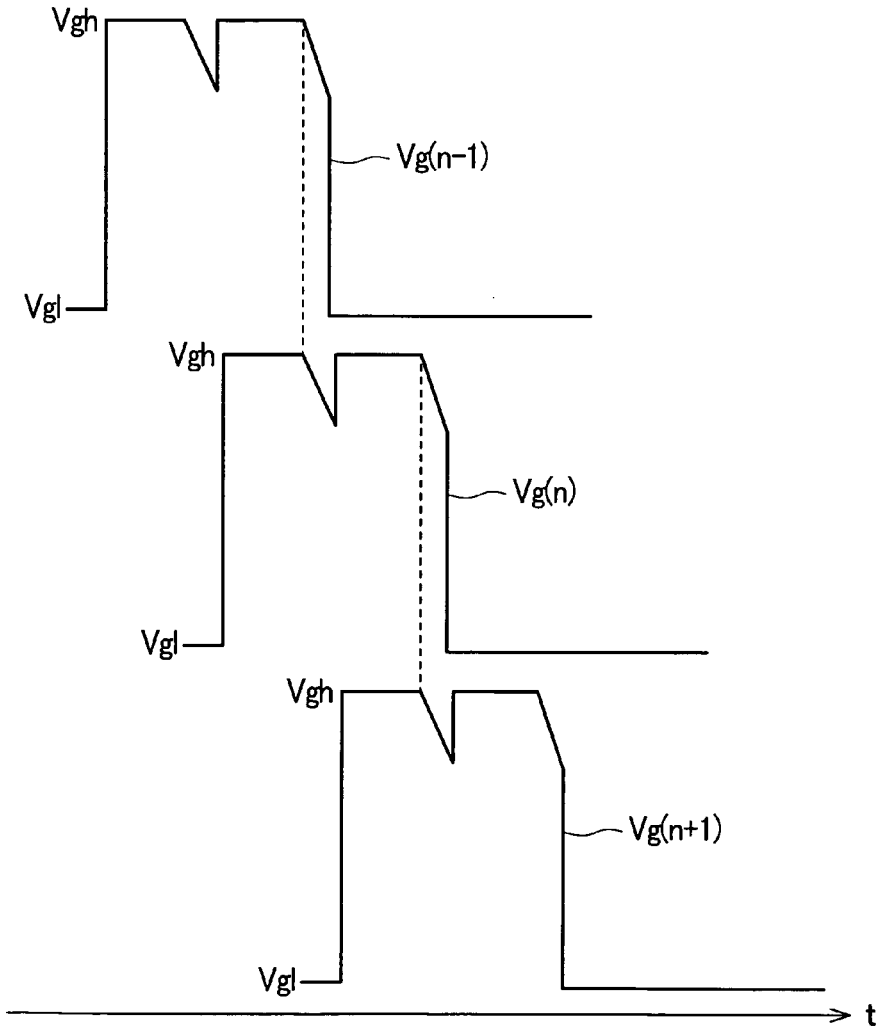
FIG. 7 is a timing chart showing timing at which the scanning signal which is applied to the display device according to the present invention is sequentially supplied to gate signal lines.

FIG. 7 shows another embodiment of the display device according to the present invention and shows the scanning signals Vg which are supplied to the respective gate signal lines GL which are arranged close to each other.

In an upper stage of FIG. 7, the scanning signal Vg (N−1) which is supplied to the gate signal line GL (N−1) positioned as the (N−1)th line from above is shown. In a middle stage of FIG. 7, the scanning signal Vg (N) which is supplied to the gate signal line GL (N) positioned as the (N)th line from above is shown. Further, in a lower stage of FIG. 7, the scanning signal Vg (N+1) which is supplied to the gate signal line GL (N+1) positioned as the (N+1)th line from above is shown.

Here, the respective waveforms of respective scanning signals Vg (N−1), Vg (N), Vg (N+1) are equal to the waveform of the scanning signal Vg shown in FIG. 5. Further, the scanning signals Vg (N−1), the scanning signal Vg (N) and the scanning signal Vg (N+1) are supplied to the corresponding gate signal lines GL in a state that as viewed in terms of time, the scanning signal Vg (N−1) and the scanning signal Vg (N) are partially overlapped to each other and, at the same time, the scanning signal Vg (N) and the scanning signal Vg (N+1) are partially overlapped to each other.

That is, the scanning signal Vg (N−1) and the scanning signal Vg (N) are overlapped to each other in a state that the gentle voltage lowering portion (portion in the section D in FIG. 6) in the reducing portion RD of the scanning signal Vg (N−1) and the gentle voltage lowering portion (portion in the section B in FIG. 6) in the valley portion VL of the scanning signal Vg (N) are aligned with each other in terms of time.

In the same manner, the scanning signal Vg (N) and the scanning signal Vg (N+1) are overlapped to each other in a state that the gentle voltage lowering portion (portion in the section D in FIG. 6) in the reducing portion RD of the scanning signal Vg (N) and the gentle voltage lowering portion (portion in the section B in FIG. 6) in the valley portion VL of the scanning signal Vg (N+1) are aligned with each other in terms of time.

Due to such a constitution, the portions which are overlapped to each other, that is, the gentle voltage lowering portion in the reducing portion RD of one scanning signal Vg and the gentle voltage lowering portion in the valley portion VL of another scanning signal Vg can be formed using the same feeding voltage and hence, it is possible to prevent the circuit from becoming complicated.

Further, the respective scanning signals Vg can perform original functions thereof in the sections C and D shown in FIG. 6 and the remaining sections A and B serve to function as a precharge period and hence, it is possible to enhance the efficiency of precharge.

Further, in this case, it is desirable to apply the video signal Vd to the drain signal lines DL such that the polarity of the drain signal lines DL is fixed until the scanning of all gate signal lines GL is finished. It is because that by applying the video signal Vd to the drain signal lines DL in such a manner, it is possible to obtain the sufficient precharge effect.

Figure 8:
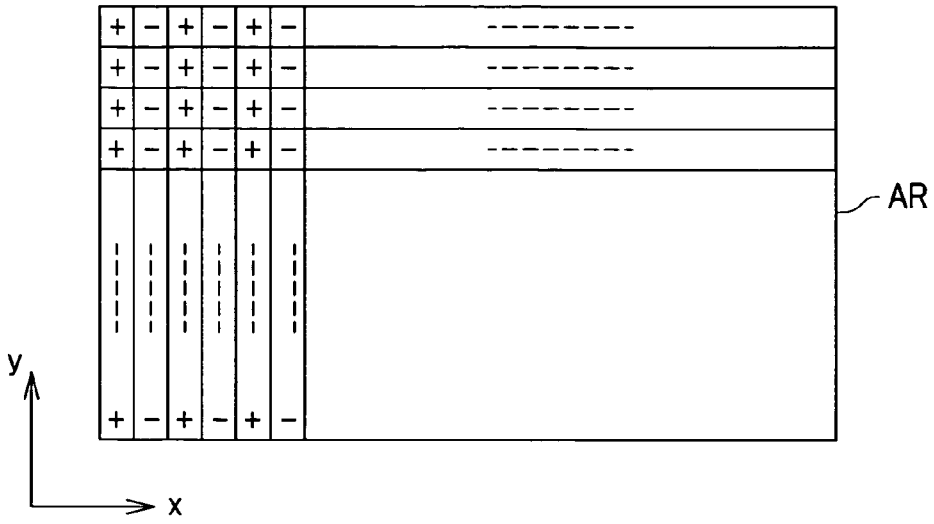
FIG. 8 is a view showing polarities of the video signal which is supplied to the drain signal line in the supply of the scanning signal in FIG. 7.

FIG. 8 shows, in the liquid crystal display part AR, the polarities of the pixel electrodes for the counter electrodes in respective pixels by +, −. As can be clearly understood from the drawing, all of respective pixels in the pixel row in the y direction in the drawing have the same polarity, and these polarities are alternately exchanged for every pixel in the x direction. Accordingly, the liquid crystal display part AR is configured such that the polarities of the video signal lines DL are exchanged for every neighboring pixel row. Further, so-called frame inversion driving which exchanges polarities alternately between frames is performed.

Due to such driving, the writing efficiency can be enhanced and it is also possible to have a flicker suppressing effect.

Figure 9:
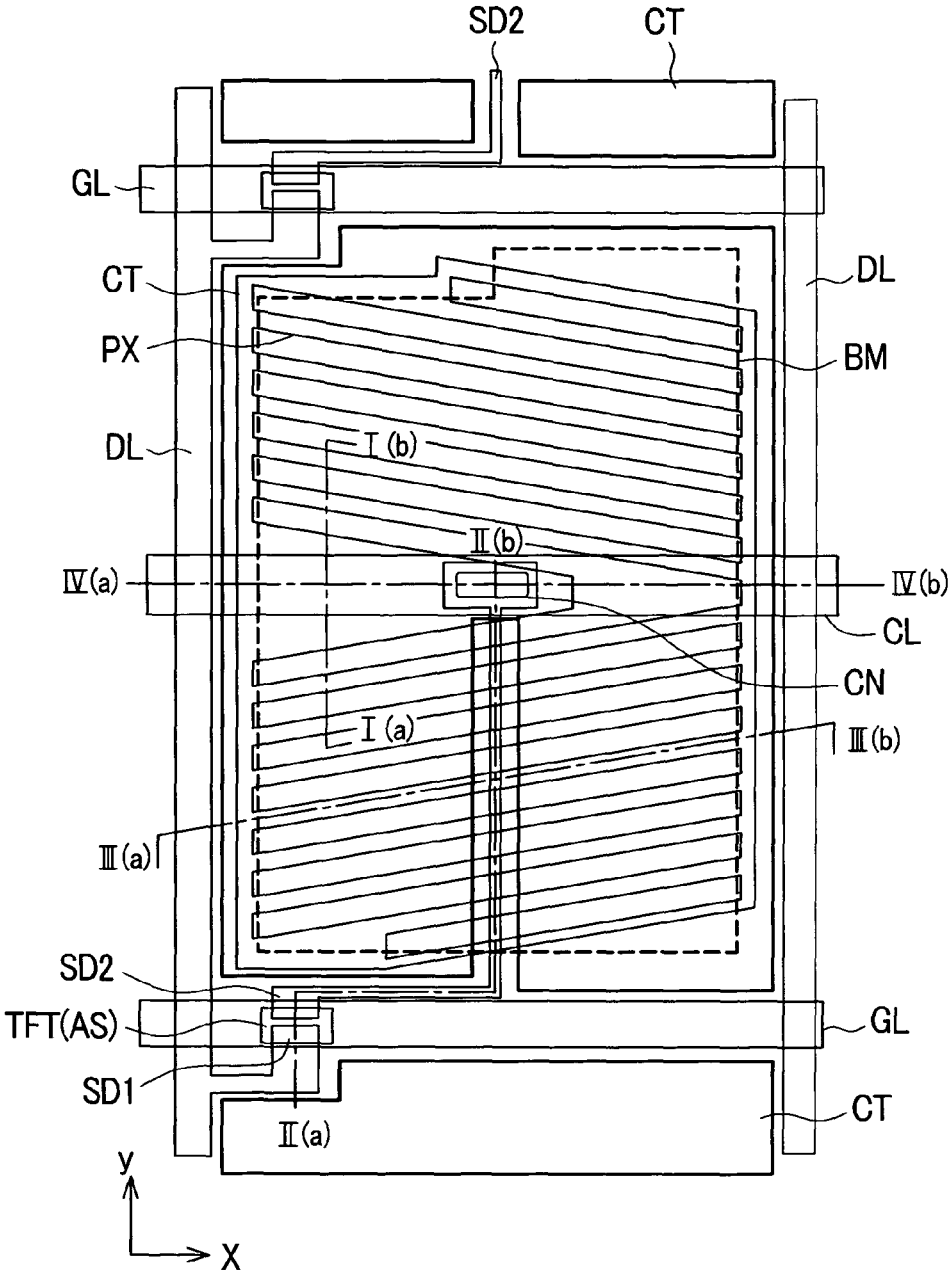
FIG. 9 is a plan view showing one embodiment of the constitution of the pixel of the display device according to the present invention.

FIG. 9 is a plan view showing one embodiment of the specific constitution of the pixel corresponding to the equivalent circuit shown in FIG. 2C.

Figure 10:
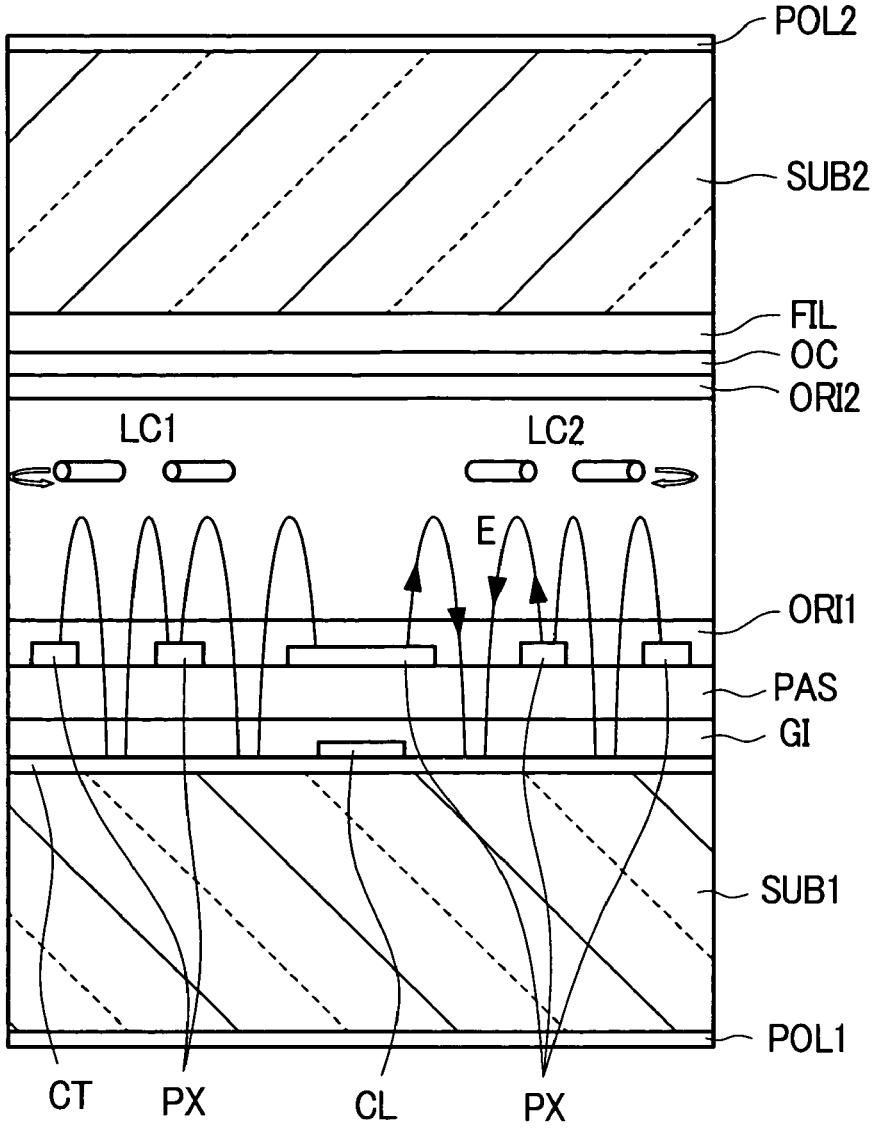
FIG. 10 is a cross-sectional view taken along a line I(a)-I(b) in FIG. 9.
Figure 11:
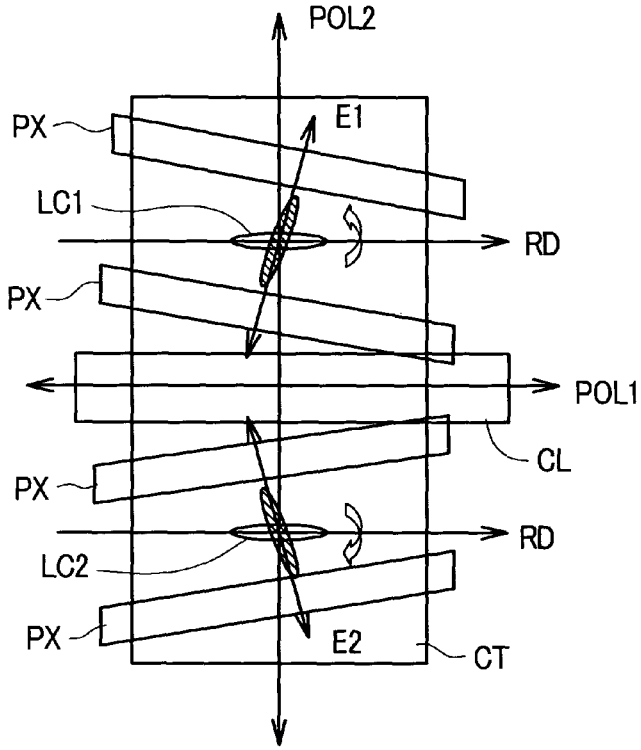
FIG. 11 is a schematic plan view showing operations of liquid crystal molecules in a liquid crystal mode having the constitution shown in FIG. 9 when a voltage is turned on or turned off.
Figure 12:
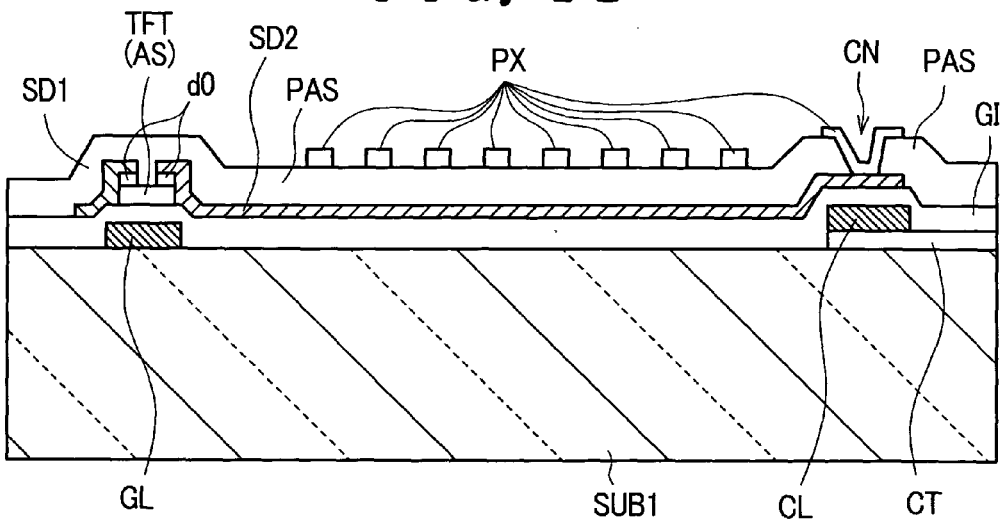
FIG. 12 is a cross-sectional view taken along a line II(a)-II(b) in FIG. 9.
Figure 13:
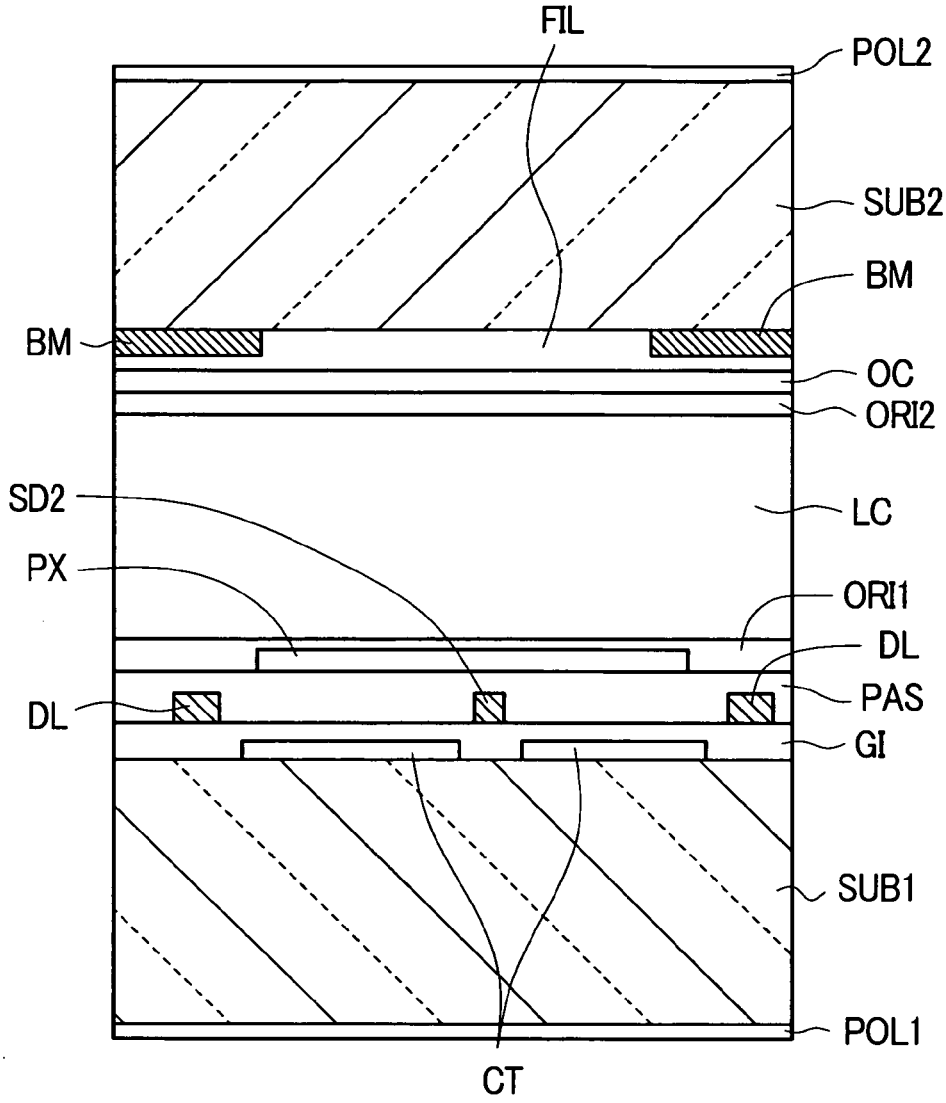
FIG. 13 is a cross-sectional view taken along a line III(a)-III(b) in FIG. 9.
Figure 14:
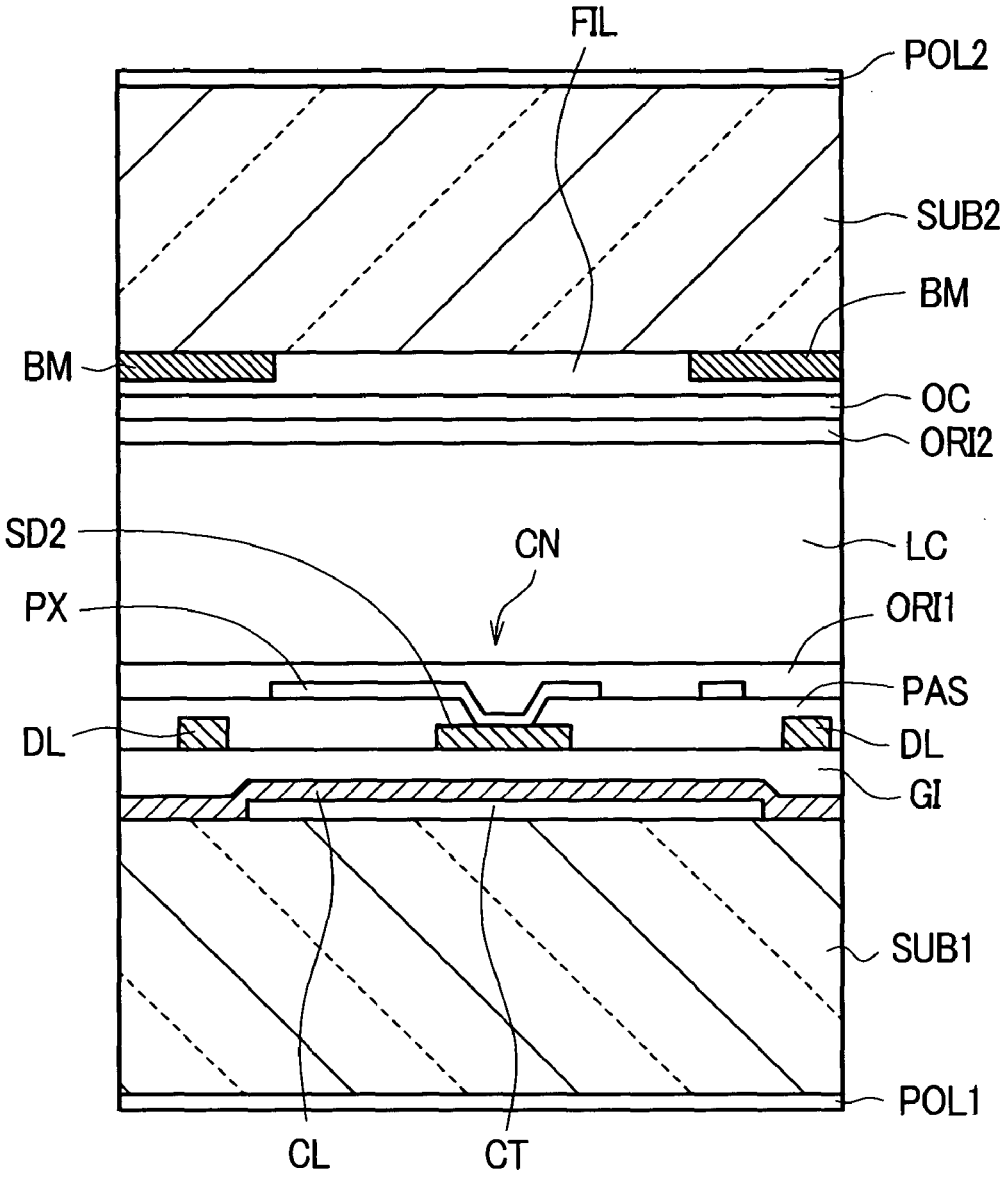
FIG. 14 is a cross-sectional view taken along a line IV(a)-IV(b) in FIG. 9.

FIG. 10 is a cross-sectional view taken along a line I(a)-I(b) in FIG. 9, FIG. 12 is a cross-sectional view taken along a line II(a)-II(b) in FIG. 9, FIG. 13 is a cross-sectional view taken along a line III(a)-III(b) in FIG. 9, and FIG. 14 is a cross-sectional view taken along a line IV(a)-IV(b) in FIG. 9. FIG. 11 is a plan view which schematically shows an operation when a voltage applied to liquid crystal molecules in a liquid crystal mode of the present invention is turned ON and OFF.

First of all, in FIG. 9, the gate signal lines GL which extend in the x direction in the drawing and are arranged in parallel in the y direction in the drawing are formed of a three-layered stacked film which are formed by stacking a molybdenum (Mo) film, an aluminum (Al) film and a molybdenum (Mo) film from the first transparent substrate side, for example. The gate signal line GL forms a rectangular region together with the drain signal lines DL described later and the region constitutes the pixel region.

Further, the counter electrode CT which generates an electric field between the counter electrode CT and the pixel electrode PX described later is formed in the pixel region, the counter electrode CT is formed over the substantially whole region of the center of the pixel region except for a trivial periphery of the pixel region, and is formed of a transparent conductor such as ITO (Indium Tin Oxide), for example. Here, although the counter electrode CT is partially notched, this provision is explained later.

The counter electrode CT is connected with the counter voltage signal line CL which is arranged substantially in the vicinity of the center of the neighboring gate signal lines GL parallel to the above-mentioned gate signal lines GL, and the counter voltage signal line CL is integrally formed with the counter voltage signal lines CL which are formed in the same manner as the counter electrodes CT in the left and right pixel regions in the drawing (the respective pixel regions which are arranged along the gate signal lines GL).

The counter voltage signal line CL is formed of an opaque material having a three-layer stacked film consisting of a molybdenum (Mo) film, an aluminum (Al) film and a molybdenum (Mo) film, for example.

Further, as mentioned above, by setting a material of the counter voltage signal line CL equal to a material of the gate signal line GL, it is possible to form the counter voltage signal line CL and the gate signal line GL using the same step and hence, it is possible to avoid the increase of the manufacturing man-hours.

Here, it is needless to say that the counter voltage signal line CL is not limited to the above-mentioned three-layer stacked film, and the counter voltage signal line CL may be formed of a single-layer film made of Cr, Ti or Mo or a two-layer film or a three-layer film containing such film and a film made of a material containing Al.

However, in this case, it is effective to position the counter voltage signal line CL above the counter electrode CT. This is because that a selective etchant (for example, HBr) for the ITO film which constitutes the counter electrode CT easily dissolves Al.

Further, it is effective to interpose high-melting-point metal such as Ti, Cr, Mo, Ta, W or the like on at least a contact surface between the counter voltage signal line CL and the counter electrode CT. This is because that ITO which constitutes the counter electrode CT oxidizes Al in the counter voltage signal line CL thus generating a high-resistance layer.

Accordingly, as one embodiment, in forming the counter voltage signal line CL made of Al or a material containing Al, it is preferable to adopt the multi-layered structure using the above-mentioned high-melting-point metal as first layer.

Further, on an upper surface of the transparent substrate on which the counter electrodes CT, the counter voltage signal lines CL and the gate signal lines GL are formed, an insulation film GI made of SiN, for example, is formed to cover also the counter electrodes CT, the counter voltage signal lines CL and the gate signal lines GL.

The insulation film GI has a function of an interlayer insulation film between the counter voltage signal line CL and the gate signal line GL with respect to the drain signal line DL described later, a function of a gate insulation film with respect to a region where the thin film transistor TFT described later is formed, and a function of a dielectric film with respect to a region for forming the capacitive element Cstg described later.

Then, the thin film transistor TFT is formed on a portion (left lower portion in the drawing) of the gate signal line GL in a overlapped manner, wherein a semiconductor layer AS made of a-Si, for example, is formed on the insulation film GI at such a portion.

By forming a drain electrode SD1 and a source electrode SD2 on an upper surface of the semiconductor layer AS, an MIS-type transistor having the inversely staggered structure which forms a portion of the gate signal line GL to the gate electrode is formed. Then, the drain electrode SD1 and the source electrode SD2 are formed simultaneously with the drain signal line DL.

That is, the drain signal lines DL which extend in the y direction in the drawing in FIG. 1 and are arranged in parallel in the x direction in the drawing are formed, portions of the drain signal lines DL extend to surfaces of the semiconductor layers AS of the thin film transistors TFT thus constituting the drain electrodes SD1 of the thin film transistors TFT.

Further, the source electrodes SD2 are formed at the time of forming the drain signal lines DL, and the source electrodes SD1 are extended to the inside of the pixel regions thus also integrally forming contact holes CN for establishing the connection with the pixel electrodes PX described later.

Here, as shown in FIG. 12, a contact layer d0 doped with n-type impurities, for example, is formed on an interlayer between the source electrode SD2 and the drain electrode SD1 of the semiconductor layer AS.

The contact layer d0 is formed such that an n-type impurity doping layer is formed over the whole region of a surface of the semiconductor layer AS, the source electrode SD2 and the drain electrode SD1 are formed and, thereafter, the n-type impurity doping layer formed on the surface of the semiconductor layer AS exposed from the respective electrodes is etched using the respective electrodes as masks.

Then, on the surface of the transparent substrate on which the thin film transistors TFT are formed, a protective film PAS made of SiN, for example, is formed in a state that the protective film PAS also covers the thin film transistors TFT. This provision is made to prevent the direct contact between the thin film transistor TFT and the liquid crystal LC.

Further, on an upper surface of the protective film PAS, the pixel electrodes PX are formed of a transparent conductive film made of ITO (Indium-Tin-Oxide), for example.

The pixel electrodes PX are formed in an extending manner at an equal interval in a state that the pixel electrodes PX are overlapped on the region where the counter electrodes CT are formed and the pixel electrodes PX make an angle of approximately 10° with respect to the x direction in the drawing and both ends of the pixel electrodes PX are connected with each other using the same material layers extending in the y direction.

Here, in this embodiment, a distance L between the neighboring pixel electrodes PX is set to a value which falls within a range of 3 to 10 μm, for example, while a width W of the pixel electrode PX is set to a value which falls within a range of 2 to 6 μm.

In this case, the material layer which constitutes the lower end of each pixel electrode PX is connected with a contact portion of the source electrode SD2 of the thin film transistor TFT via a contact hole formed in the protective film PAS, while the material layer which constitutes the upper end of each pixel electrode PX is formed in a state that the upper end of the pixel electrode PX is overlapped to the counter electrode CT.

Due to such a constitution, at an overlapped portion between the counter electrode CT and each pixel electrode PX, a capacitive element Cstg which uses a stacked film of the gate insulation film GI and the protective film PAS as a dielectric film is formed.

The capacitive element Cstg is provided for storing the video signal to the pixel electrode PX relatively long even when the thin film transistor TFT is turned off after the video signal from the drain signal line DL is applied to the pixel electrode PX through the thin film transistor TFT.

Here, the capacitance of the capacitive element Cstg is proportional to an overlapped area of the counter electrode CT and each pixel electrode PX and the area becomes relatively large. The dielectric film is constituted of the laminated structure formed of the insulation film GI and the protective film PAS.

Further, the material of the protective film PAS is not limited to SiN and it is needless to say that the protective film PAS may be formed of a synthetic resin, for example. In this case, by forming the protective film PAS by coating, it is possible to obtain an advantageous effect that even when the protective film PAS having a large thickness is formed, it is possible to easily manufacture the protective film PAS.

Then, on the transparent substrate SUB1 on which the pixel electrodes PX and the counter electrodes CT are formed, an orientation film ORI1 is formed in a state that the orientation film ORI1 also covers the pixel electrodes PX and the counter electrodes CT. The orientation film ORI1 is a film which is brought into direct contact with the liquid crystal LC and serves to determine the initial orientation direction of the liquid crystal LC.

In the above-mentioned embodiment, the explanation is made with respect to the case in which ITO is used as the transparent conductive film. However, it is needless to say that the substantially same effect can be obtained by using, for example, the IZO (Indium-Zinc-Oxide) as the transparent conducive film.

The first transparent substrate SUB1 having such a constitution is referred to as a TFT substrate, while the second transparent substrate SUB2 which is arranged to face the TFT substrate with the liquid crystal LC therebetween is referred to as a filter substrate.

The filter substrate is formed, as shown in FIG. 3, FIG. 6 or FIG. 7, such that a black matrix BM is, first of all, formed on a liquid-crystal-side surface to define the respective pixel regions, and filters FIL are formed in opening portions which determine the substantial pixel regions of the black matrix BM so as to cover the opening portions.

Then, an overcoat film OC made of a resin film, for example, is formed in a state that the overcoat film OC covers the black matrix BM and the filters FIL, and an orientation film ORI2 is formed on an upper surface of the overcoat film.

The above describes the schematic planar constitution and the cross-sectional constitution of the embodiment 1. Next, the manner of operation of this liquid crystal mode is explained in conjunction with FIG. 10 and FIG. 11. In this embodiment, as the liquid crystal, so-called positive nematic liquid crystal in which the long-axis direction of the liquid crystal molecules is aligned with the direction of the electric field is used. The turning ON and OFF of the liquid crystal display exhibits the behavior having the normally-black voltage-transmissivity characteristic in which the liquid crystal display performs a black state when there is no electric field and performs a white display when the voltage is applied.

FIG. 10 is a cross-sectional view taken along a chain double-dashed line which connects I(a)-I(b) in FIG. 9. As viewed from a front in FIG. 10, a left side is depicted as I(a) and a right side is depicted as I(b). In this in-plane display mode (that is, the pixel electrodes PX and the counter electrodes CT being formed on the first transparent substrate SUB1 side), lines of electric force (E in FIG. 10) from comb-teeth-shaped pixel electrode PX is applied to the liquid crystal LC, passes through the protective film PAS and the gate insulation film GI in a gap of the comb teeth, and reaches the counter electrode CT which is formed in the whole surface of the pixel region in a substantially rectangular shape. In FIG. 10, the liquid crystal molecules LC1 on the left side with respect to the center counter voltage signal line CL (that is, the lower region of the counter voltage signal line CL which runs in the lateral direction in the pixel region shown in FIG. 9) rotate in the clockwise direction with respect to the direction substantially parallel to the first substrate SUB1. On the other hand, the liquid crystal molecules LC2 on the right side with respect to the center counter voltage signal line CL in FIG. 10 rotate in the counterclockwise direction with respect to the direction substantially parallel to the first substrate SUB1.

An optical operation of the liquid crystal molecules LC1, LC2 is explained in conjunction with FIG. 11 which is a schematic plan view. The counter voltage signal line CL is arranged on a center region of one pixel in the lateral direction. In the region above the center region, the comb-teeth-like pixel electrode PX extends with an inclination of approximately 10 degree in the clockwise direction with respect to the counter voltage signal line CL, while in the region below the center region, the comb-teeth-like pixel electrode PX extends with an inclination of approximately 10 degree in the counterclockwise direction with respect to the counter voltage signal line CL. Here adopted is the so-called cross-nicol polarization axes arrangement in which a polarization axis in the polarizer of the first substrate SUB1 is arranged in the direction parallel to the extending direction of the counter voltage signal line CL and a polarization axis in the polarizer of the second substrate SUB2 side is arranged in the direction perpendicular to the extending direction of the counter voltage signal line CL. The rubbing which performs a direction control of the liquid crystal molecules on interfaces thereof with the orientation films (ORL1, ORL2) is performed in the direction parallel to both of the upper and lower substrate sides (parallel to the extending direction of the counter voltage signal line CL and the gate signal line GL).

When no voltage is applied to the liquid crystal or when the applied voltage is small, long axes of the liquid crystal molecules LC1, LC2 are aligned in the extending direction of the counter voltage signal line CL. The pixel electrode PX in the upper region has the inclination of 10 degrees in the clockwise direction. On the other hand, when the voltage is applied to the liquid crystal, the direction of the lines of electric force E which reach the counter electrode CT from the pixel electrode PX shown in the cross section in FIG. 10 through the liquid crystal is perpendicular to the pixel electrode PX, that is, has an angle of 110 degrees in the clockwise direction with respect to the counter voltage signal line CL. The liquid crystal molecules LC1 follow this behavior and rotate in the electric field direction, that is, in the counterclockwise direction, wherein the transmissivity becomes maximum when the long axis is rotated in the direction which makes 45 degrees with respect to the polarization axis of the polarizer. Since the pixel electrodes PX are arranged in the vertical symmetry with respect to the counter voltage signal line CL, the liquid crystal molecules in the lower region are rotated in the clockwise direction opposite to the rotational direction. In this embodiment, the liquid crystal molecules in one pixel are divided into two regions in the clockwise direction and in the counterclockwise direction and hence, a viewing angle of the screen is not inverted as viewed in any direction and, at the same time, it is possible to provide a display with a wide viewing angle with a small color change. Further, the pixel electrodes PX and the counter electrodes CT are formed of transparent ITO and, at the same time, a sufficient electric field is applied to the liquid crystal LC and hence, it is possible to display a bright image which passes the whole pixel region inside the black matrix BM.

Next, the feature of the embodiment which allows the pixel structure to have the enhanced numerical aperture and transmissivity and to have the favorable image quality which makes the occurrence of point defects difficult is explained hereinafter.

A maximum cause which drops the numerical aperture lies in the increase of rates that areas of the source electrode SD2 and the drain electrode SD1 occupy in addition to a rate that an area of the gate signal line GL, the drain signal line DL, the counter voltage signal line CL or the like which is made of an opaque metal material occupies. Particularly, as in the case of this embodiment, when it is necessary to connect the source electrode SD2 formed on the gate insulation film GI and the pixel electrode PX formed on the protective film PAS via the contact hole CN, the area of the source electrode SD1 in the vicinity of the contact hole CN is increased corresponding to the increase of the thickness of the protective film PAS and hence, the numerical aperture is lowered.

Further, there may be a case that the transmissivity is substantially lowered due to other reasons besides the pattern designing of the thin film transistor TFT. The largest cause is a case in which the orientation films for the interface control of liquid crystal molecules are not favorably rubbed. Particularly, with respect to the contact hole CN having a large stepped portion, the rubbing is not sufficiently performed in the vicinity of the contact hole CN, and in a portion which corresponds to a shade in the rubbing direction, a shade-like region in which the liquid crystal molecules are not controlled spreads with an area several times as large as an area of the contact hole. This phenomenon causes not only the simple lowering of the transmissivity but also the disturbance of control of the liquid crystal molecules thus providing an image with a lowered response speed. Although it is necessary to perform the shielding of light with the opaque material such as the black matrix BM or the lines on the first substrate SUB1 to eliminate the influence on at least the response speed, this may lower the numeral aperture to the contrary.

Hereinafter, the structure which is taken to cope with the drawback is explained in conjunction with the drawings. To avoid the lowering of the numerical aperture, by arranging in advance the source electrode SD2 of the above-mentioned contact hole CN in a state that the source electrode SD2 extends over the counter voltage signal line CL which constitutes the opaque region from the thin film transistor TFT in an overlapped manner, there is no possibility that the loss of transmissivity is newly increased. In this case, however, there arises a new drawback that defects such as point defects are increased.

In the liquid crystal display mode of this embodiment, as described above, the transparent counter electrode CT is arranged in a rectangular shape in the inside of the pixel, the gate insulation film GI and the protective film PAS are stacked on the counter electrode CT, and the transparent pixel electrode PX is arranged on the gate insulation film GI and the protective film PAS. The stacked areas of both electrodes occupy 20 to 30% of one pixel region and this value is larger than a corresponding value of other liquid crystal mode. When pin holes or the like are formed in the insulation film, the short-circuiting failure occurs thus giving rise to point defects on the screen. To minimize such point defects, this embodiment adopts the redundant structure in which the stacked film is constituted of two insulation films, that is, the gate insulation film GI and the protective film PAS, which are formed by different steps thus allowing another film to maintain the insulation even when pin holes are formed in one film.

Here, as mentioned above, to enhance the transmissivity, as shown in FIG. 14, the source electrode SD2 of the contact hole CN may be formed on the counter voltage signal line CL. Accordingly, by simply extending the source electrode SD2 from the drain electrode SD1 of the thin film transistor TFT as shown in FIG. 9, the source electrode SD1 extends over the single-layered gate insulation film GI on the counter electrode CT and it is evident that the redundancy against the short-circuiting defect is damaged.

In this embodiment, first of all, as can be understood from FIG. 9 which is a plan view, a slit-like cut is formed in the counter electrode CT which is arranged below a region to which the source electrode SD1 extends. Due to such a constitution, there is no possibility that the lower counter electrode CT and the source electrode SD1 cause the short-circuiting failure. As can be understood from the cross-sectional structure shown in FIG. 12, the source electrode SD1 is initially overlapped to a single-layered portion of the gate insulation film GI at a portion where the source electrode SD1 is overlapped to the counter voltage signal line CL. Due to such a constitution, even when the transmissivity is enhanced, the generation of point defects can be prevented thus obtaining the favorable image quality.

On the other hand, the pixel electrode PX which is arranged on the protective film PAS in a state that the pixel electrode PX traverses the source electrode SD1 is overlapped to the single-layered protective film PAS with a large area. However, since the same image potential is applied to the pixel electrode PX and the source electrode SD1, even when the pixel electrode PX and the source electrode SD1 are short-circuited physically by a chance, there arise no point defects. Accordingly, it is possible to layout the pixel electrode PX in the same manner as the upper region in FIG. 9 above the counter voltage signal line CL which has no slit in the counter electrode CT. Accordingly, it is possible to suppress the lowering of the numerical aperture attributed to the formation of the slit. The slit of the counter electrode is set slightly wider than the source electrode SD1 which is formed in a minimum working size shown in FIG. 13 by taking the positional displacement of the respective layers in a photolithography step into consideration.

On the other hand, the disturbance of the liquid crystal orientation attributed to the rubbing of the contact hole CN can be reduced as follows thus enhancing the transmissivity. As explained in conjunction with FIG. 11, the rubbing direction is arranged parallel to the gate signal line GL and the counter voltage signal line CL. Accordingly, the disturbance of the liquid crystal molecules attributed to the rubbing shade which is several times as large as a diameter of the contact hole CN occurs along the counter voltage signal line CL. As can be understood from FIG. 9 which is a plan view, the counter voltage signal line CL extends in the rubbing direction of the contact hole CN and blocks the light source on the first transparent substrate SUB1 side.

The above-mentioned embodiments have been explained by taking the liquid crystal display device as an example. However, it is needless to say that the present invention is applicable to other display device such as an organic EL display device, for example. This is because that the organic EL display device also includes, in the same manner as the liquid crystal display device, a pixel region which uses an intersecting portion of a gate signal line and a drain signal line as one corner thereof, and the pixel region includes a thin film transistor which is turned on in response to the supply of a signal (scanning signal) from the gate signal line, and an electrode to which a signal (video signal) from the drain signal line is supplied through the thin film transistor.

The above-mentioned respective embodiments may be used individually or in combination. This is because that it is possible to obtain the advantageous effects of the respective embodiments in a signal form or synergistically.

What is claimed is:

1. A display device in which each pixel includes a thin film transistor which is turned on in response to a scanning signal from a gate signal line, and an electrode to which a video signal from a drain signal line is supplied through the thin film transistor, wherein the scanning signal has a valley portion which decreases a voltage level temporarily in the middle of the impression period of the high-level voltage which turns on the thin film transistor of the pixel, the valley portion which is held at the voltage level is gradually lowered along with a lapse of time and, thereafter, rises steeply, and the decreased voltage level of the valley portion is set to a value which is equal to or more than a voltage level which turns off the thin film transistor.

2. A display device according to claim 1, wherein the valley portion which is held at the voltage level falls for a time t1 and rises for a time t2, wherein a relationship t1>t2 is established.

3. A display device according to claim 1, wherein the decreased voltage level of the valley portion of the scanning signal line is set larger than the voltage level of the video signal supplied to the thin film transistor.

4. A display device according to claim 1, wherein the decreased voltage level of the valley portion of the scanning signal line is set larger than the voltage level.

5. A display device according to claim 2, wherein the decreased voltage level of the valley portion of the scanning signal line is set larger than the voltage level.

6. A display device in which each pixel includes a thin film transistor which is turned on in response to a scanning signal from a gate signal line, and an electrode to which a video signal from a drain signal line is supplied through the thin film transistor, wherein the scanning signal has a valley portion which decreases a voltage level temporarily in the middle of the impression period of the high-level voltage which turns on the thin film transistor of the pixel, the valley portion has a decreasing portion which gradually decreases the voltage level immediately before turning off the thin film transistor and a rising portion which the voltage level steeply reaches a low level of the scanning signal, and the decreased voltage level of the valley portion is set to a value which is equal to or more than a voltage level which turns off the thin film transistor.

7. A display device according to claim 6, wherein the valley portion which is held at the voltage level falls for a time t1 and rises for a time t2, wherein a relationship t1>t2 is established.

8. A display device according to claim 6, wherein the decreased voltage levels of the valley portion and the decreasing portion of the scanning signal line are set larger than the voltage level of the video signal supplied to the thin film transistor.

9. A display device according to claim 6, wherein the decreased voltage levels of the valley portion and the decreasing portion of the scanning signal line are set larger than the voltage level of the video signal supplied to the thin film transistor.

10. A display device according to claims 7, wherein the decreased voltage levels of the valley portion and the decreasing portion of the scanning signal line are set larger than the voltage level of the video signal supplied to the thin film transistor.

11. A display device in which each pixel includes a thin film transistor which is turned on in response to a scanning signal from a gate signal line, and an electrode to which a video signal from a drain signal line is supplied through the thin film transistor, wherein the scanning signal has a valley portion which decreases a voltage level temporarily in the middle of the impression period of the high-level voltage which turns on the thin film transistor of the pixel, and the valley portion has a decreasing portion which gradually decreases the voltage level immediately before turning off the thin film transistor and a rising portion which the voltage level steeply reaches a low level of the scanning signal, and the decreased voltage level of the valley portion is set to a value which is equal to or more than a voltage level which turns off the thin film transistor, and one scanning signal and another scanning signal which is supplied next to one scanning signal are supplied in a partially overlapped manner in a state that the decreasing portion of one scanning signal and the valley portion of another scanning signal are aligned with each other in terms of time.

12. A display device according to claim 11, wherein the valley portion which is held at the voltage level falls for a time t1 and rises for a time t2, wherein a relationship t1>t2 is established.

13. A display device according to claim 11, wherein the decreased voltage levels of the valley portion and the decreasing portion of the scanning signal line are set larger than the voltage level of the video signal supplied to the thin film transistor.

14. A display device according to claim 11, wherein the decreased voltage levels of the valley portion and the decreasing portion of the scanning signal line are set larger than the voltage level of the video signal supplied to the thin film transistor.

* * * * *